US008517250B2

(12) United States Patent
Philips

(10) Patent No.: US 8,517,250 B2
(45) **Date of Patent: *Aug. 27, 2013**

(54) STACKING DRAWER PACKAGE

(75) Inventor: Nicholas A Philips, Sugar Grove, IL (US)

(73) Assignee: International Paper Company, Memphis, TN (US)

( * ) Notice: Subject to any disclaimer, the term of this patent is extended or adjusted under 35 U.S.C. 154(b) by 644 days.

This patent is subject to a terminal disclaimer.

(21) Appl. No.: 12/140,521

(22) Filed: Jun. 17, 2008

(65) Prior Publication Data

US 2009/0308779 A1 Dec. 17, 2009

(51) Int. Cl.
*B65D 21/00* (2006.01)
*B65D 5/38* (2006.01)
*B65D 43/00* (2006.01)

(52) U.S. Cl.
USPC ..... 229/125.125; 206/509

(58) Field of Classification Search
USPC ..... 229/125.125, 120.32, 125.001, 902, 229/906, 103.2, 147, 174, 919; 206/474, 206/464
See application file for complete search history.

(56) References Cited

U.S. PATENT DOCUMENTS

| | | | | |
|---|---|---|---|---|
| 1,824,927 | A | 9/1931 | Powell | |
| 2,790,589 | A | 4/1957 | Moore | |
| 2,944,717 | A | 7/1960 | Lynch | |
| 2,964,229 | A * | 12/1960 | Mansfield | 206/526 |
| 3,395,849 | A | 8/1968 | Gillam | |
| 3,398,000 | A * | 8/1968 | Peters | 426/119 |
| 4,265,393 | A * | 5/1981 | Orchard | 229/103.3 |
| 5,092,467 | A * | 3/1992 | Elward | 206/784 |
| 5,180,075 | A * | 1/1993 | Montalbano | 229/103.11 |
| 5,294,044 | A * | 3/1994 | Clark | 229/191 |
| 6,394,337 | B1 * | 5/2002 | Ross et al. | 229/103.2 |
| 6,729,533 | B2 | 5/2004 | Wozniacki | |
| 7,124,890 | B2 | 10/2006 | McLeod et al. | |
| 2003/0010816 | A1 | 1/2003 | Jackson | |
| 2005/0145687 | A1 | 7/2005 | Conway | |
| 2006/0186186 | A1 | 8/2006 | Kuhn | |
| 2009/0308785 | A1 * | 12/2009 | Philips | 206/745 |

FOREIGN PATENT DOCUMENTS

| | | |
|---|---|---|
| DE | 2914882 | 10/1980 |
| DE | 9216430 | 2/1993 |
| DE | 9207105 | 6/1993 |
| GB | 1255476 | 12/1971 |
| GB | 2229426 | 9/1990 |
| WO | 2005000691 | 1/2005 |

* cited by examiner

*Primary Examiner* — Gary Elkins
*Assistant Examiner* — Christopher Demeree
(74) *Attorney, Agent, or Firm* — Matthew M. Eslami

(57) ABSTRACT

A tray has a bottom panel, side and end panels and top shoulders at opposed ends of the tray. The tray is covered by a separate sleeve that extends across the top of the tray and down opposed sides and across the bottom of the tray. The trays may be stacked with an upper tray resting on the shoulders of the lower tray. The sleeve is a sleeve for the stack of trays with the side panels of the sleeve sized for different numbers of trays in the stack. There may be frictional tabs in the side panels of the tray or trays which have frictional engagement with the side panels of the sleeve.

2 Claims, 6 Drawing Sheets

STACKING DRAWER PACKAGE

This is directed to a container which may be stacked and which has a separate sleeve for one or multiple containers.

People often order more than one pizza when ordering take-out. Each of the pizzas are placed in a separate box having a cover. The packaging for these pizzas costs more.

In the present invention it is proposed to provide one cover for multiple pizzas. This reduces the amount of material required to ship the pizzas and the amount of material going to be discarded.

DETAILED DESCRIPTION OF THE INVENTION

While stacks of three containers is shown it should be understood that the sleeves can be sized to fit one or a stack of any number of containers.

Throughout the application the term "attachment line" is used to denote score lines, reverse score lines and slit and score lines.

Figure 1:
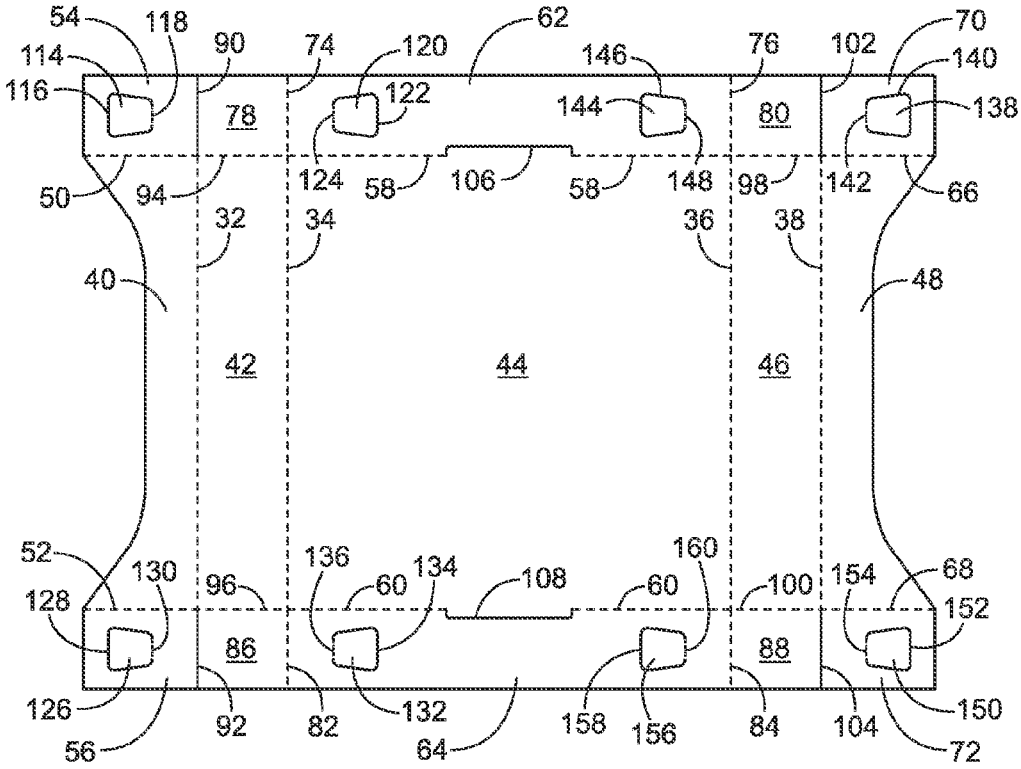
FIG. 1 is a top plan view of one embodiment of a blank for a pizza container.
Figure 2:
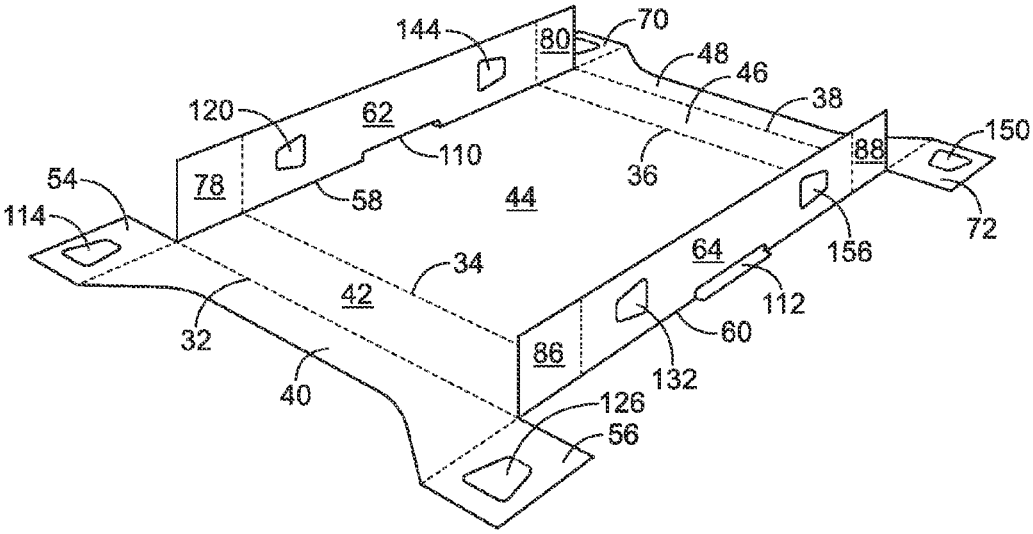
FIGS. 2-6 are isometric views showing the formation of the container from the blank of FIG. 1.
Figure 3:
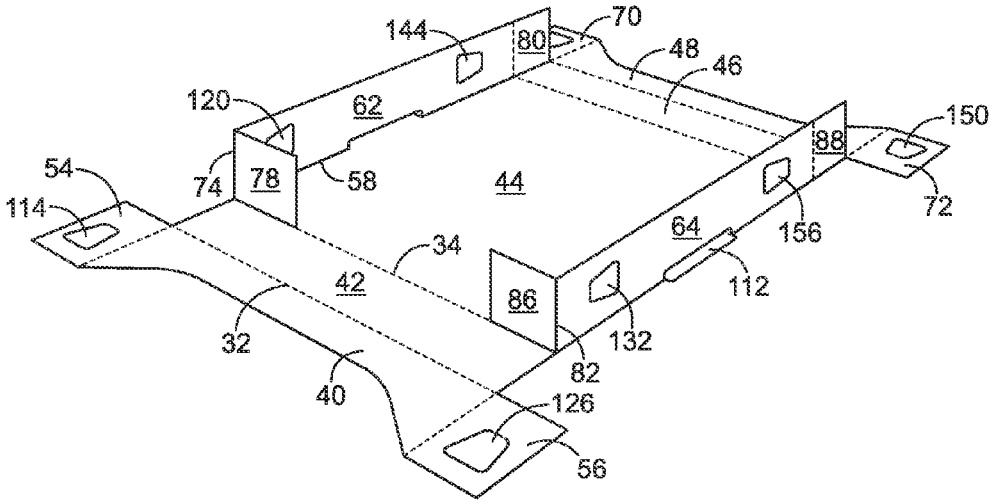
Figure 4:
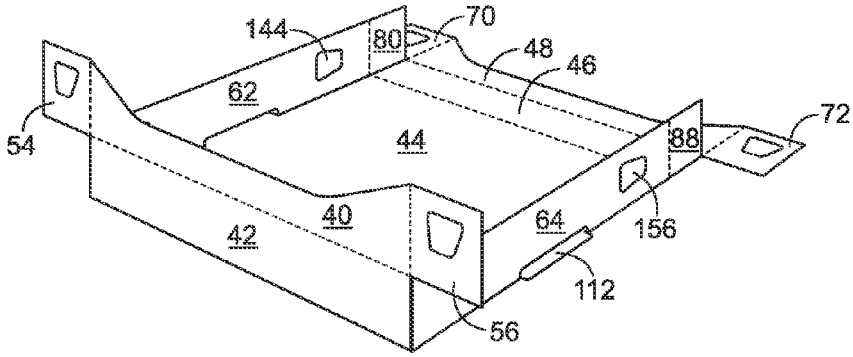
Figure 5:
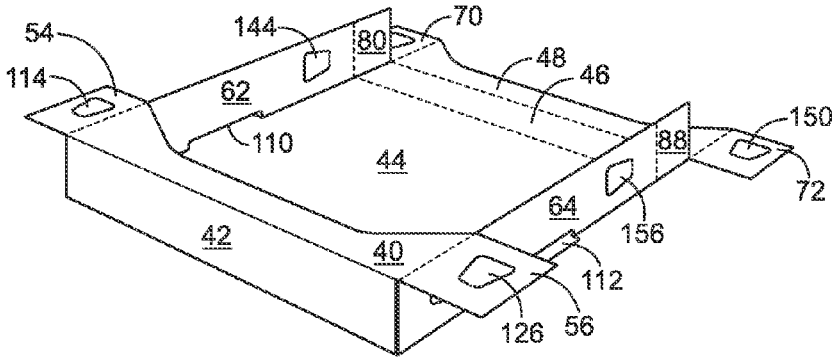
Figure 6:
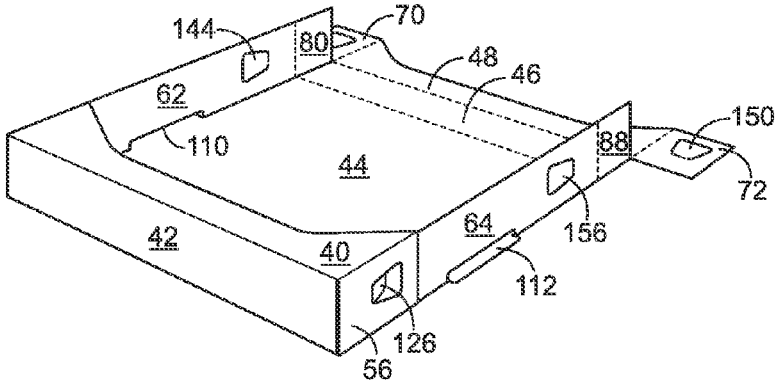

In FIG. 1, the blank 30 is divided by transverse parallel attachment lines 32, 34, 36 and 38 into a shoulder panel 40, a front panel 42, a bottom panel 44' a back panel 46 and a shoulder panel 48. A pair of parallel longitudinal attachment lines 50 and 52 attach a pair of side flaps 54 and 56 to shoulder panel 40. A pair of parallel longitudinal attachment lines 58 and 60 attach a pair of side panels 62 and 64 to bottom panel 44. A pair of parallel longitudinal attachment lines 66 and 68 attach a pair of side flaps 70 and 72 to shoulder panel 48. A pair of transverse parallel attachment lines 74 and 76 attach front and back flaps 78 and 80 to the front and back sides of side panel 62. A pair of transverse parallel attachment lines 82 and 84 attach front and back flaps 86 and 88 to the front and back sides of side panel 64.

The front and back flaps are separated from adjacent flaps and panels by cut lines or slots. A pair of transverse cut lines or slots 90 and 92 separate, respectively, side flap 54 from front flap 78 and side flap 56 from front flap 86. A pair of parallel longitudinal cut lines or slots 94 and 96 separate, respectively, front panel 42 from front flap 78 and front panel 42 from front flap 86. A pair of parallel longitudinal cut lines or slots 98 and 100 separate, respectively, back panel 46 from back flap 80 and back panel 46 from back flap 88. A pair of transverse cut lines or slots 102 and 104 separate, respectively, side flap 70 from back flap 80 and side flap 72 from back flap 88.

The attachment lines 50, 58 and 66 and the cut lines or slots 94 and 98 are substantially in alignment. The attachment lines 50 and 66 will be offset slightly outwardly of attachment line 58 to allow the flaps 54 and 70 to be on the outside of panel 62 in the formed container. The cut lines or slots 94 and 98 should be placed to allow the flaps 78 and 80 to be on the inner face of the front panel 42 and the back panel 46, respectively, in the formed container.

Similarly, the attachment lines 52, 60 and 68 and the cut lines or slots 96 and 100 are substantially in alignment. The attachment lines 52 and 68 are offset slightly outwardly of attachment line 60 to allow the flaps 56 and 72 to be on the outside of panel 64 in the formed container. The cut lines or slots 96 and 100 are placed to allow the flaps 86 and 88 to be on the inner face of the front panel 42 and the back panel 46, respectively, in the formed container.

The transverse attachment lines 74 and 82 are in substantial alignment with attachment line 34. The transverse attachment lines 74 and 82 are offset slightly inwardly of the attachment line 34 to allow the flaps 78 and 86 to be inside the front panel 42 in the formed container. The transverse attachment lines 76 and 84 are in substantial alignment with attachment line 36. The attachment lines 76 and 84 are offset slightly inwardly of the attachment line 34 to allow the flaps 78 and 86 to be inside the front panel 42 in the formed container.

There are friction tabs formed along the bottom of the container. These are formed by cut lines 106 and 108 located along the longitudinal attachment lines 58 and 60 and centrally of the side panels 62 and 64. The cut lines 106 and 108 are slightly offset from the attachment lines 58 and 60 and have ends that intersect the attachment lines 58 and 60 to form friction tabs 110 and 112 which bear against the sleeve when the tray is inserted into the sleeve.

Consequently the term "in alignment" means the attachment lines and cut lines or slots will be in alignment or slightly offset depending of the placement of the panels, flaps and tabs in the formed container.

There are pairs of locking tabs formed in the side flaps attached to the shoulder panels and in the side panels. These are used to form the container and hold it in its erected form.

One pair of locking tabs is locking tab 114 formed in side flap 54 and locking tab 120 formed toward the front of side panel 62. Locking tab 114 is formed by cut lines 116 around three sides of the locking tab 114 and by attachment line 118 forming the fourth side of the locking tab 114. Locking tab 120 is formed by cut lines 122 around three sides of the locking tab 120 and attachment line 124 forming the fourth side of the locking tab 120.

Another pair of locking tabs is locking tab 126 formed in side flap 56 and locking tab 132 formed toward the front of side panel 64. Locking tab 126 is formed by cut lines 128 around three sides of the locking tab 126 and by attachment line 130 forming the fourth side of the locking tab 126. Locking tab 132 is formed by cut lines 134 around three sides of the locking tab 132 and attachment line 136 forming the fourth side of the locking tab 132.

Another pair of locking tabs is locking tab 138 formed in side flap 70 and locking tab 144 formed toward the back of side panel 62. Locking tab 138 is formed by cut lines 140 around three sides of the locking tab 138 and by attachment line 142 forming the fourth side of the locking tab 138. Second back locking tab 144 is formed by cut lines 146 around three sides of the locking tab 144 and attachment line 148 forming the fourth side of the locking tab 144.

Another pair of locking tabs is locking tab 150 formed in side flap 72 and locking tab 156 formed toward the back of side panel 64. Locking tab 150 is formed by cut lines 152 around three sides of the locking tab 150 and by attachment line 154 forming the fourth side of the locking tab 150. Locking tab 156 is formed by cut lines 158 around three sides of the locking tab 156 and attachment line 160 forming the fourth side of the locking tab 156.

In each of the pairs of locking tabs, the attachment lines are shown as facing each other. This is one embodiment. In the formed container, the locking tabs are congruent and the attachment lines of each pair are contiguous. Both attachment lines in the blank can be on facing sides as shown, or both can be on the top or bottom of the tab, or they can be opposed to each other. One tab in each tab pair is needed to lock the sides in place. An aperture can be used in place of the other tab in each locking tab pair.

The formation of the container is shown in FIGS. 2-7. The side panels 62 and 64 and their associated flaps 78, 80, 86 and 88 are bent upwardly around attachment lines 58 and 60. The flaps 78 and 86 are bent inwardly around their attachment lines 74 and 82. Front panel 42 and its attached shoulder panel and flaps 40, 54 and 56 are bent upwardly around attachment line 34 until the front panel 42 rests against the front sides of side panels 62 and 64. The shoulder panel 40 and its attached flaps 54 and 56 are bent downwardly around attachment line 32 until the shoulder panel rests on the upper edges of the side panels 62 and 64. Side flaps 54 and 56 are bent downwardly around attachment lines 50 and 52 until the flaps are against side panels 62 and 64. The locking tab 114 is now aligned with locking tab 120 with the attachment line 118 substantially contiguous with attachment line 124. The locking tab 126 is now aligned with locking tab 132 with the attachment line 130 substantially contiguous with attachment line 136. The pair of locking tabs 114 and 120 and the pair of locking tabs 126 and 132 are pushed into the container to lock the front panel 42, shoulder panel 40, side flaps 54 and 56, and side panels 62 and 64 in place.

Figure 7:
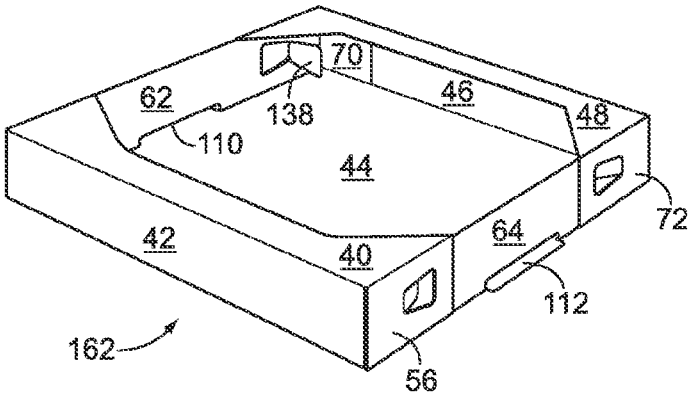
FIG. 7 is an isometric view of the pizza container assembled from the blank of FIG. 1.

The product is placed within the container. The flaps 80 and 88 are bent inwardly around their attachment lines 76 and 84. The back panel 46 and its associated shoulder panel 48 and flaps 70 and 72 are bent upwardly around attachment line 36 until the back panel rests against the back sides of side panels 62 and 64. The shoulder panel 48 and its associated flaps 70 and 72 are bent downwardly around attachment line 38 until the shoulder panel 48 rests on the top edges of side panels 63 and 64. The flaps 70 and 72 are bent downwardly around attachment lines 66 and 68 until the flaps are against the sides of side panels 62 and 64. The locking tab 138 is now aligned with locking tab 144 with the attachment line 142 substantially contiguous with attachment line 148. The locking tab 150 is now aligned with locking tab 156 with the attachment line 154 substantially contiguous with attachment line 160. The pair of locking tabs 138 and 144 and the pair of locking tabs 150 and 156 are pushed into the container to lock the back panel 46, shoulder panel 40, side flaps 70 and 72, and side panels 62 and 64 in place. The formed container 162 is shown in FIG. 7.

Figure 8:
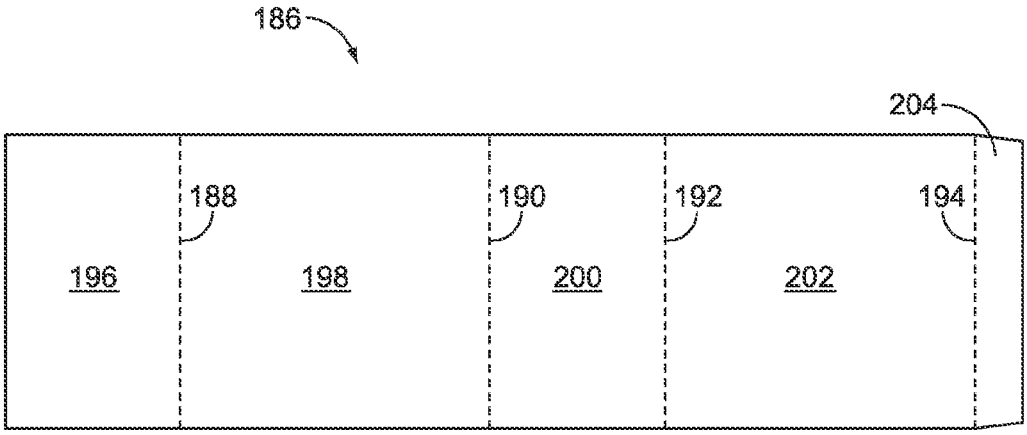
FIG. 8 is a top plan view of a blank for a sleeve for a stack of three pizza containers.
Figure 9:
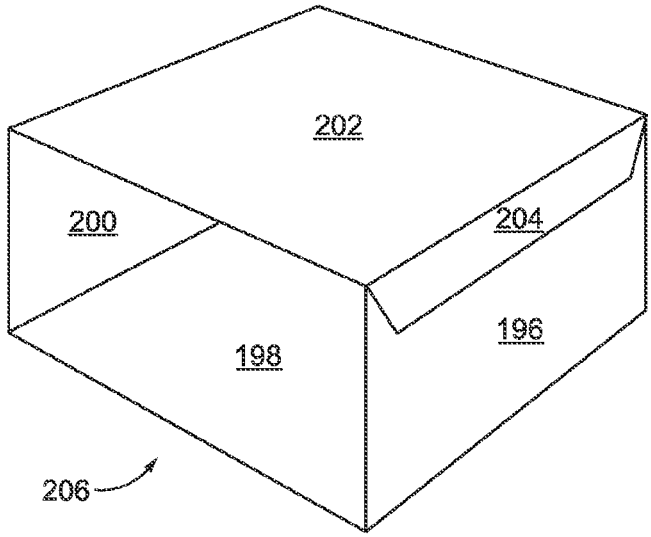
FIG. 9 is an isometric view of a formed sleeve.
Figure 10:
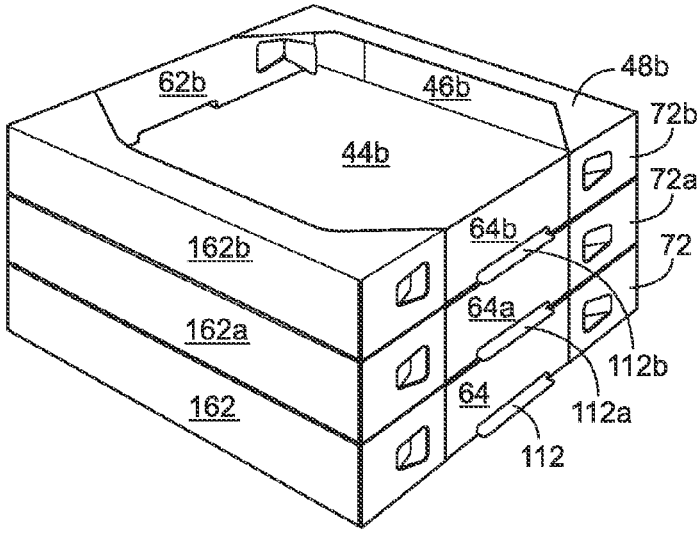
FIGS. 10 and 11 are isometric views of the assembly of a stack of three pizza containers with a sleeve.
Figure 11:
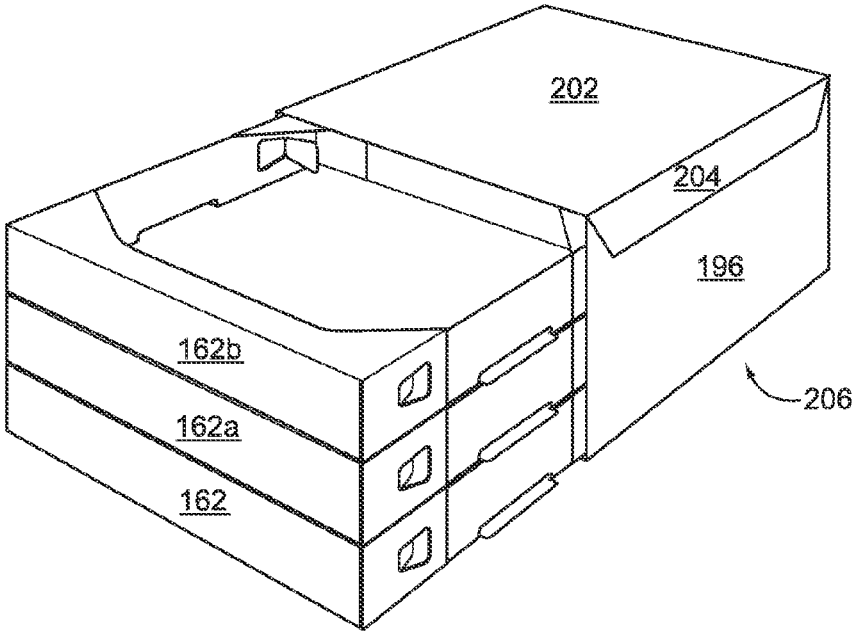
Figure 12:
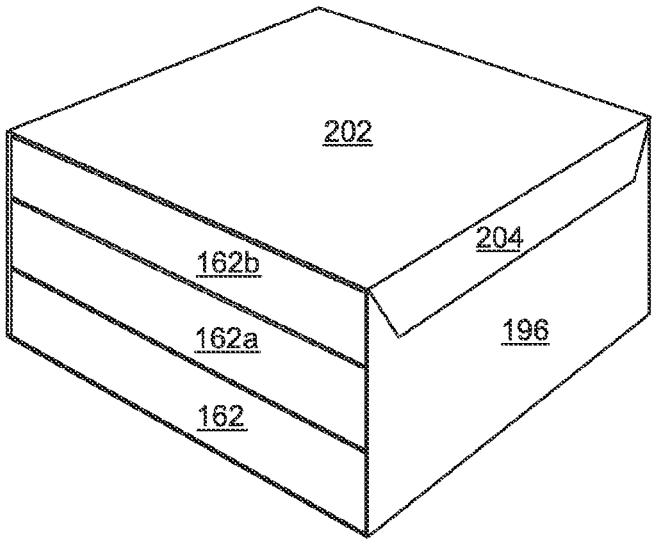
FIG. 12 is an isometric view of the formed package.

FIG. 8 shows a blank 186 for the sleeve 206. The blank 186 is divided by transverse sleeve attachment lines 188, 190, 192 and 194 into a sleeve side panel 196, a sleeve bottom panel 198, a sleeve side panel 200, a sleeve top panel 202 and a sleeve glue panel 204. To form the sleeve 206, the glue panel 204 is glued to the outer edge of the sleeve side panel 196 as shown in FIG. 9. FIGS. 10 and 11 show the formation of a stack of containers with the sleeve. The three containers 162, 162*a* and 162*b* are filled and placed in the sleeve. In a stack of containers each of the upper containers in the stack rest on the shoulder panels of the container below it. A stack of three containers is shown but sleeves can be sized for any number of containers. A sleeve can even be used for one container. The only difference between sleeves is the height of the side walls which are sized to fit over the single container or the stack of containers. The friction tabs 110 and 112 bear against the side panels of the sleeve to hold the trays in the sleeve during transport.

The package is described as being used for pizzas but may be used for other products.

The package may be made with corrugated board, containerboard or fiberboard, or combinations of these.

It will be understood that other changes can be made to the trays and sleeve without departing from the spirit of the invention.

The invention claimed is:

1. A multi-layered container comprising a stack of trays; each tray comprising a bottom panel, front, back and side panels extending upwardly from the bottom panel, each of the side panels includes a pair of inner locking tabs spaced apart from one another;

horizontal shoulder panels attached to the upper edge of each of the front and back panels, the horizontal shoulder panels being in a plane parallel to the bottom panel, each of the horizontal shoulder panels includes a pair of outer locking tabs wherein the outer locking tabs engages with the corresponding inner locking tabs to hold the side panels and back panels in vertical position;

a separate parallelogram sleeve being sized for the stack of trays comprising a top panel, a pair of rigid and un-creased side panels and a bottom panel, the sleeve top panel being in surface contact with the horizontal tray shoulder panels (40, 48) to form multi-layered horizontal areas on a top side of the multi-layered container, the sleeve side panels being congruent with the tray side panels, the sleeve bottom panel being congruent with one or more of the tray bottom panels, and a glue panel being attached to the top panel and glued to an outside of one of the un-creased side panels forming the sleeve which has a rectangular inner shape wherein the sleeve permits partially or fully removal of one of the stacked trays in a longitudinal direction.

2. A multi-layered container assembly comprising at least two trays providing a top tray and a bottom tray, each tray comprising a bottom panel, front, back and side panels extending upwardly from the bottom panel, each of the side panels includes a pair of inner locking tabs spaced apart from one another;

horizontal shoulder panels attached to the upper edge of each of the front and back panels, the shoulder panels being in a plane parallel to the bottom panel, each of the horizontal shoulder panels includes a pair of outer locking tabs wherein the outer locking tabs engages with the corresponding inner locking tabs to hold the side panels and back panels in vertical position;

the trays being stacked with the upper tray resting on the shoulders of the tray beneath it, a separate parallelogram sleeve being sized for a stack of trays comprising a top panel, a pair of rigid and un-creased side panels and a bottom panel, the sleeve top panel being in surface contact with the horizontal tray shoulder panels (40, 48) to form a multi-layered horizontal areas on a top side of the multi-layered container, the sleeve side panels being congruent with the tray side panels, the sleeve bottom panel being congruent with one or more of the tray bottom panels, and a glue panel being attached to the top panel and glued to an outside of one of the un-creased side panels forming the sleeve which has a rectangular inner shape wherein the sleeve permits partially or fully removal of one of the stacked trays in a longitudinal direction.

* * * * *